US009255574B2

(12) United States Patent
Garcia-Lorenzana et al.

(10) Patent No.: US 9,255,574 B2
(45) Date of Patent: Feb. 9, 2016

(54) ROTARY PUMP FOR A VEHICLE

(75) Inventors: Ignacio Garcia-Lorenzana, Frankfurt am Main (DE); Joel Op De Beeck, Lint (BE); Stephane Leonard, Brussels (BE); Vincent Potier, Brussels (BE); Jean-Baptiste Gouriet, Genval (BE); Frédéric Jannot, Bousval (BE)

(73) Assignee: INERGY AUTOMOTIVE SYSTEMS RESEARCH (Societe Anonyme), Brussels (BE)

( * ) Notice: Subject to any disclaimer, the term of this patent is extended or adjusted under 35 U.S.C. 154(b) by 843 days.

(21) Appl. No.: 13/121,873

(22) PCT Filed: Sep. 28, 2009

(86) PCT No.: PCT/EP2009/062506

§ 371 (c)(1),
(2), (4) Date: Aug. 5, 2011

(87) PCT Pub. No.: WO2010/037703

PCT Pub. Date: Apr. 8, 2010

(65) Prior Publication Data

US 2011/0311373 A1 Dec. 22, 2011

(30) Foreign Application Priority Data

Oct. 2, 2008 (FR) ..... 08 56688

(51) Int. Cl.

| | |
|---|---|
| ***F01N 3/08*** | (2006.01) |
| ***F04C 2/10*** | (2006.01) |
| ***F04C 11/00*** | (2006.01) |

(52) U.S. Cl.

CPC ..... *F04C 2/10* (2013.01); *F04C 11/008* (2013.01); *F01N 2610/1433* (2013.01); *F04C 2240/803* (2013.01); *F04C 2240/81* (2013.01); *F04C 2270/18* (2013.01); *Y10T 137/86035* (2015.04)

(58) Field of Classification Search

CPC ..... F01N 3/0842; F01N 3/0807; F01N 3/00; F01N 3/04; F01N 3/08; F04B 17/03; F04D 13/0606; F04D 13/0686; F04D 13/064

USPC ..... 60/272, 274, 286, 287, 295, 282; 417/410.4, 410.3, 410.1, 423.11

See application file for complete search history.

(56) References Cited

U.S. PATENT DOCUMENTS 2,139,373 A * 12/1938 McKinley et al. ..... 418/102
3,180,267 A * 4/1965 Bemmann et al. ..... 417/369

(Continued)

FOREIGN PATENT DOCUMENTS

CN 2685612 Y 3/2005
CN 101059134 A 10/2007

(Continued)

OTHER PUBLICATIONS

Combined Office Action and Search Report issued Oct. 9, 2012 in Chinese Application No. 200980141276.9 (English Translation).

(Continued)

*Primary Examiner* — Alexander Comley

(74) *Attorney, Agent, or Firm* — Oblon, McClelland, Maier & Neustadt, L.L.P.

(57) ABSTRACT

A rotary pump can pump a liquid for pollution control of exhaust gases in a system on board a vehicle and can include a rotor and a stator that are positioned in a casing. The casing can include a wall delimiting a main internal volume and an integral outlet pipe for the pump. A pressure sensor can be positioned within the main internal volume of the casing.

2 Claims, 4 Drawing Sheets

(56) References Cited

U.S. PATENT DOCUMENTS

| | | | | | |
|---|---|---|---|---|---|
| 3,212,449 | A | * | 10/1965 | Whalen et al. | 417/310 |
| 3,495,538 | A | * | 2/1970 | Kruckeberg | 417/372 |
| 3,667,870 | A | * | 6/1972 | Yoshida et al. | 417/357 |
| 4,459,817 | A | | 7/1984 | Inagaki et al. | |
| 5,120,201 | A | * | 6/1992 | Tuckey et al. | 417/366 |
| 5,613,844 | A | * | 3/1997 | Tuckey et al. | 417/366 |
| 5,785,013 | A | * | 7/1998 | Sinn et al. | 123/41.44 |
| 5,884,475 | A | * | 3/1999 | Hofmann et al. | 60/274 |
| 6,065,946 | A | * | 5/2000 | Lathrop | 417/423.14 |
| 6,209,315 | B1 | * | 4/2001 | Weigl | 60/274 |
| 6,443,715 | B1 | * | 9/2002 | Mayleben et al. | 417/423.1 |
| 6,725,651 | B2 | * | 4/2004 | Itoh et al. | 60/286 |
| 2004/0093856 | A1 | * | 5/2004 | Dingle et al. | 60/286 |
| 2004/0115074 | A1 | * | 6/2004 | Huber et al. | 417/413.1 |
| 2006/0275163 | A1 | * | 12/2006 | Pike | 417/423.9 |
| 2007/0045027 | A1 | | 3/2007 | Nonaka et al. | |
| 2008/0107549 | A1 | * | 5/2008 | Crary et al. | 417/410.1 |
| 2008/0276601 | A1 | * | 11/2008 | Katou et al. | 60/287 |
| 2008/0310976 | A1 | * | 12/2008 | Boutros | 417/410.1 |
| 2009/0019835 | A1 | * | 1/2009 | Dingle | 60/282 |
| 2009/0101656 | A1 | * | 4/2009 | Leonard | 220/562 |

FOREIGN PATENT DOCUMENTS

| | | | | | |
|---|---|---|---|---|---|
| CN | 201045751 | Y | | 4/2008 | |
| DE | 19848413 | A1 | | 4/2000 | |
| DE | 102007047885 | A1 | | 6/2008 | |
| EP | 1219836 | A2 | | 7/2002 | |
| JP | 2005-83364 | A | | 3/2005 | |
| JP | 2005-98268 | A | | 4/2005 | |
| JP | 2005-240693 | A | | 9/2005 | |
| JP | 2007-62613 | A | | 3/2007 | |
| JP | 2007-97257 | | | 4/2007 | |
| JP | 2008-157218 | | | 7/2008 | |
| JP | 2008157218 | A | * | 7/2008 | |
| JP | 2008-157218 | | * | 10/2008 | 60/274 |
| WO | WO 2007141312 | A1 | | 12/2007 | |
| WO | WO 2008048147 | A1 | | 4/2008 | |
| WO | WO 2009007405 | A1 | | 1/2009 | |

OTHER PUBLICATIONS

"Commission Directive 2002/80/EC of Oct. 3, 2002 adapting to technical progress Council Directive 70/220/EEC relating to measures to be taken against air pollution by emissions from motor vehicles", Official Journal of the European Communities, 2002, pp. L291/20-L291/56; 37 pgs.

Office Action issued Oct. 22, 2013 in Japanese Patent Application No. 2011-529517 (with English language translation).

* cited by examiner

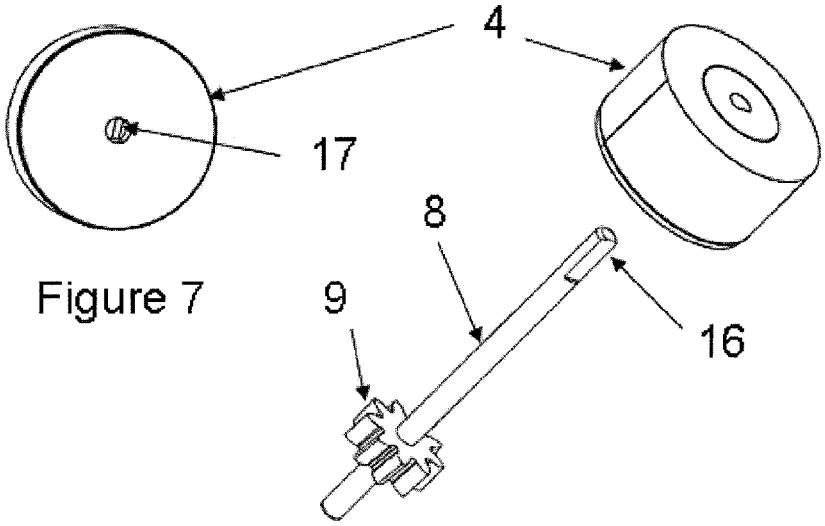
Figure 7
Figure 6
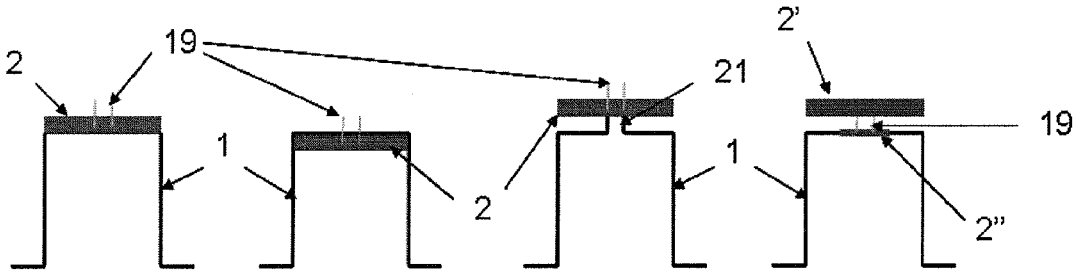
Figure 8 Figure 9 Figure 10 Figure 11

ROTARY PUMP FOR A VEHICLE

CROSS-REFERENCE TO RELATED APPLICATIONS

This application is a U.S. national stage application under 35 U.S.C. §371 of International Application No. PCT/EP2009/062506 filed Sep. 28, 2009, which claims priority to FR Application No. 08.56688 filed Oct. 2, 2008, these applications being herein incorporated by reference in their entirety for all purposes.

TECHNICAL FIELD OF THE INVENTION

The present invention relates to a rotary pump intended to be on board a vehicle and in particular, a pump for a urea Selective Catalytic Reduction (SCR) system; it also relates to a tank equipped with such a pump and also to the use of this pump/tank in an SCR system.

BACKGROUND OF THE INVENTION

With the Euro IV standard on exhaust emissions from heavy goods vehicles coming into effect in 2005, devices for pollution control of $NO_x$ (or nitrogen oxides) have had to be put in place.

The system used by most heavy goods vehicle manufacturers for reducing $NO_x$ emissions to the required value consists in carrying out a selective catalytic reaction with reducing agents such as urea ("Urea SCR" or selective catalytic reduction using ammonia generated in situ in the exhaust gases by decomposition of urea).

In order to do this, it is necessary to equip the vehicles with a tank containing a urea solution, a device for metering the amount of urea to be injected into the exhaust line and a device for supplying, with urea solution, the device for metering the amount of urea to be injected. Generally, the supply device comprises a rotary pump driven by a motor.

The vehicles may be equipped with other liquid pumps, for example with a fuel pump, with a pump that may meter an additive directly into the fuel (diesel in particular) in order to reduce the emission of particulates, etc.

One feature in common to these "onboard" pumps lies in the fact that they should ideally have a limited size for optimum efficiency (both in terms of pressure and speed). These pumps are generally rotary pumps driven by a motor of any type, preferably a magnetically-coupled motor in order to avoid the use of dynamic seals.

Thus, Application PCT/EP2008/058943, in the name of the Applicant, the content of which is for this purpose incorporated by reference in the present application, describes a rotary fuel pump driven by a magnetically coupled motor. Such a pump delivers a controlled liquid flow, both the flow rate and pressure of which are controlled. One means for controlling the flow delivered is to implant a pressure sensor in the SCR system, at the pump outlet and to regulate the operation of the pump so that the pressure at the pump outlet follows a setpoint pressure value. The sensor may be implanted into the supply device of the SCR system. A solution of this type necessitates a manual assembly of the sensor to the device and therefore an additional assembly cost.

An alternative solution consists in attaching the pressure sensor directly to the pump. In this case it is the size of the pump/sensor assembly which is adversely affected. This solution also requires particular attention to the sealing at the pump/sensor interface, risks of liquid leaking from the inside to the outside of the pump being possible.

U.S. Pat. No. 5,120,201 discloses a liquid pump integrating a pressure sensor, but within the outlet pipe of said pump i.e. in a region where the pressure is not stable.

SUMMARY OF THE INVENTION

The present invention aims to provide a motor-driven rotary pump that has a reduced size and does not have the drawbacks described above.

For this purpose, the present invention relates to a rotary pump intended to pump a liquid for the pollution control of exhaust gases in a system on board a vehicle and comprising a rotor, a stator that are placed in a casing comprising a wall delimiting a main internal volume (where the rotor and the stator are actually located) and integrating an outlet pipe, and a pressure sensor which is also placed in the pump casing, but in its main internal volume and not in the outlet pipe (these two elements having each their internal volume and said internal volumes communicating with one another, but the pressure measurement being performed in the main internal volume of the pump casing, preferably in a region spaced from the outlet pipe, for instance: by positioning/fixing the pressure sensor on a wall opposite to the outlet pipe of the pump).

It is worth mentioning that the pressure is roughly the same everywhere inside the pump casing where liquid is present, but that it is more stable in the main internal volume than inside the outlet pipe. For the same reason, it is preferred not to put the pressure sensor in (or in the neighborhood of) the pump inlet.

BRIEF DESCRIPTION OF THE DRAWINGS

For a detailed description of the invention, reference will now be made to the accompanying drawings in which:

FIGS. 6 to 7 illustrate a rotation axle and a rotor of a pump according to one advantageous variant of the invention; and FIGS. 8 to 11 illustrate, schematically, various methods of fastening a pressure sensor to a rotor housing.

DESCRIPTION OF THE PREFERRED EMBODIMENTS

Figure 1:
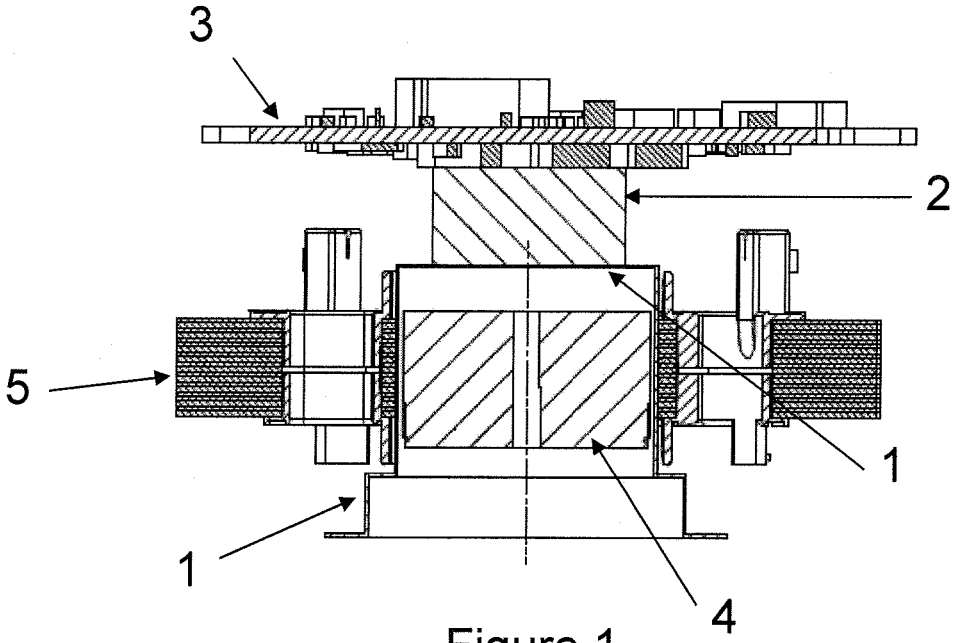
FIG. 1 is a vertical cross section through certain components of a pump according to one preferred variant of the invention.

The pump according to the invention is a rotary pump of any known type, driven by a motor, preferably a magnetically coupled motor, the control of which is preferably electronic (managed by an ECM or Electronic Control Module). In this embodiment, the pump motor is entirely integrated in the pump casing, which gives a very compact module.

The fluid for which this pump is intended is a compound that is liquid under normal usage conditions (the pump according to the invention being hence a liquid pump and not a gas compressor) and that is used in the context of the pollution control of vehicle exhaust gases. This liquid may be, for example, an additive used for the regeneration of a particulate filter (PF) or may be injected into the exhaust gases to reduce the $NO_x$ content thereof. This kind of liquid must be metered very accurately in order for the pollution control to be effective, which justifies the need for a stable pressure measurement.

In the case of a PF additive, this is generally a composition, in solution in a hydrocarbon-based solvent, of a catalyst for low-temperature combustion of solid carbonated particulates produced by the incomplete combustion of a heavy hydrocarbon in a compression-ignition engine. The expression "heavy hydrocarbon" is understood to mean a fuel that is liquid or pasty at ambient temperature, the molecules of which comprise more than 9 carbon atoms. An example of such a heavy hydrocarbon is an oil cut known as gas oil that can be used in diesel type engines. Examples of suitable liquid additives are iron and cerium salts in hydrocarbon-based solution. In particular, the solutions available under the tradename EOLYS® are especially suitable for PFs.

However, the present invention applies particularly well to a reducing agent capable of reducing the $NO_x$ present in the exhaust gases of the vehicle engine. This is advantageously an ammonia precursor in aqueous solution. The invention gives good results with aqueous solutions of urea and in particular, eutectic water/urea solutions such as solutions of AdBlue®, the urea content of which is between 31.8 wt % and 33.2 wt % and which contain around 18% of ammonia. The invention may also be applied to urea/ammonium formate mixtures also in aqueous solution, sold under the trademark Denoxium® and which contain around 13% of ammonia. The latter have the advantage, with respect to urea, of freezing only from −35° C. onwards (as opposed to −11° C.), but have the disadvantages of corrosion problems linked to the release of formic acid.

According to the invention, the pressure sensor is positioned in the main internal volume of the pump casing. The pump casing generally consists of a wall that defines said internal volume, integrates an outlet pipe for the pump and surrounds/contains/protects components of the pump, especially the rotor, the stator, the pressure sensor, a mechanical pumping element and optionally an electronic board. The fact of using the single term "casing" does not preclude partitioning of the above mentioned wall and in particular, the casing is preferably separated into one chamber that is contains no liquid and is fluid tight and one chamber in which liquid is present.

According to one preferred variant of the invention, the rotor is a magnetic one contained in a housing which is fixed (does not turn with the rotor) and which is preferably connected in a sealed manner to the outlet (discharge) pipe of the pump. The housing comprises an upper wall and has substantially the shape of a cylinder. This housing is advantageously made of stainless steel (preferably made of a grade with good resistance to urea, where appropriate). The housing may also be advantageously made of a plastic capable of withstanding contact with urea. It may, for example, be polyamide (preferably PA-6,6), PPS (polyphenylene sulfide), PPA (polyphthalamide).

The rotor housing contains liquid and in general an air pocket, the volume of which varies as a function of the pressure of the liquid in the pump in such a way that the product pressure*volume is constant. This air pocket is not evacuated since the space between the rotor and its housing has only one "opening" (in fact, it is a confined space with a free liquid surface) and therefore there is no hydraulic circuit in that part of the rotor housing. The embodiment according to which the pressure sensor is integrated in this air pocket makes it possible to limit the risks of damaging the pressure sensor when the urea freezes and increases in volume.

This air pocket being generally positioned underneath the upper wall of the housing, according to a preferred embodiment of the invention, the pressure sensor is fastened to the upper wall of the rotor housing. This location of the pressure sensor makes it possible to get a stable measure of the pressure of liquid at the pump outlet, although it is not directly measured there as explained above. The pump outlet pressure measurement is used by the ECM of the pump to regulate the pump outlet pressure so that liquid is injected with a stable pressure into the system for feeding the SCR system to an injector, independently of the control frequency of the injector, of the flow rate of liquid injected and of the pressure fluctuations caused by the exhaust gases and the opening/closing of the injector.

Preferably, the pumping effect (suction/discharge) is essentially achieved using a mechanical pumping element attached to a rotation axle. This is understood to mean an element whose geometry is such that its rotation creates a pumping effect.

A gear pump is particularly suitable.

The rotation axle is attached to the magnetic rotor which may be actuated (rotated) by application of a magnetic field. The expression "magnetic rotor" is understood to mean that the rotor preferably comprises at least one magnet. This magnet may be a single magnet and the rotation axle may pass through this magnet. Alternatively, it may be several magnets positioned (preferably in a symmetrical manner) around the axle.

The pump according to the invention comprises a stator for applying a magnetic field to the aforementioned rotor, this stator comprising one or more magnetic coils. The coils of the stator are in direct contact with the rotor via interposition of its housing. The liquid is sucked into the pump and circulates inside the housing of the rotor; it is in contact with the rotor but not with the stator.

The electric power supply for these coils and the control of the pump are preferably governed electronically, as explained previously. Hence, the pump according to the invention also comprises one or more printed circuit boards (electronic boards).

The pump generally comprises a filter which preferably surrounds the mechanical pumping element and through which the pump sucks so that it is protected from impurities.

The pump is surrounded by a casing comprising a lower chamber and a cover.

According to one preferred variant of the invention, the lower chamber comprises an upper portion that forms, with the cover and the rotor housing, a sealed chamber that surrounds the stator and the electronic boards and a lower portion that surrounds the rotor, the filter and the mechanical pumping element.

According to this variant, the rotor housing may be fastened to the lower chamber, for example via a screw connection.

Preferably, it is fastened in a sealed manner using flanges or an intermediate fastening part and a seal, for example of O-ring type. It thus separates the internal volume of the chamber into a lower portion in contact with the liquid and an upper "sealed" portion.

Preferably, the electronic board or boards for the control of the pump are integrated into the upper portion of the chamber. More preferably, the electronic board or boards are joined to the cover by screwing or clipping, the cover being fastened (for example by welding) to the upper portion of the chamber.

Also preferably, the electronic board or boards for the control of the pump are transferred to outside the pump casing.

The pressure sensor may be of any known type. A sensor of capacitive or piezoresistive type or of strain gauge type is preferred.

The pressure sensor comprises a measuring element. The measuring element may be made from various types of material. It is preferably made from ceramic, metal (in particular stainless steel) or a semiconductor.

The electric power supply and the control of the operation of the pressure sensor are preferably governed electronically. Hence, the pressure sensor also comprises a printed circuit board (electronic board) which is electrically connected to the measuring element via electrical connections.

According to the invention, the pressure sensor is positioned in the pump casing and it is, in general, integrated into a component of the pump.

The term "integrated" is understood to mean any method of fastening the sensor to a component of the pump, for example by clipping, screwing, welding, etc.

In the variant where the pressure sensor is fastened to the rotor housing, it is preferably fastened by overmolding, welding, bonding, mechanical assembling (for example screwing, clipping, etc.) to the upper wall of the housing.

In one variant of the system according to the invention, the electronic board of the pressure sensor is joined to the measuring element. Preferably, the electronic board and the measuring element are fixed onto the housing, for instance by gluing, through mechanical fixation (for instance by crimping) preferably using a seal; by overmolding . . . . A fixation by crimping gives good results in practice.

In another variant of the system according to the invention, the measuring element and the electronic board of the pressure sensor are separate.

Preferably, the casing is separated into two chambers (a sealed chamber and a chamber where the fluid is present) and the measuring element is at the interface of the two.

When the rotor is in a housing as described above, the latter advantageously constitutes at least one part of this interface.

Various embodiments of the system according to the invention may thus be envisaged.

According to a first embodiment, the measuring element and the electronic board of the sensor are fastened (for example by crimping, gluing or welding) to a side wall of the rotor housing and constitute the cover of said housing. In this variant, the upper wall of the rotor housing is therefore constituted by the electronic board and the measuring element of the sensor so that this measuring element is in contact with the fluid.

According to a second embodiment, the measuring element and the electronic board are fastened to the upper wall of the rotor housing, on the internal side of the housing, i.e. on the side where the fluid is present. An orifice is made in the upper wall of the housing so that electrical connections between the electronic board of the pressure sensor and the ECM of the pump can pass through the wall of the housing.

According to a third embodiment, the upper wall of the housing comprises a duct provided with two ends, one end leading to the inside of the rotor housing and one end to which the measuring element of the pressure sensor is fastened. The duct preferably has a diameter substantially smaller than the diameter of the rotor housing so that only the measuring element is in contact with the fluid which is present in the housing at a distance from the housing and the electronic board of the sensor is not in contact with the fluid.

According to a fourth embodiment, the measuring element is fastened to the upper wall of the rotor housing at the place of an opening made in the upper wall of the housing and the electronic board of the sensor is fastened at a distance from the housing. Preferably, the electronic board is integrated into the electronic board for controlling the pump. The assembly of the electronic board of the sensor and the electronic board for controlling the pump is, for example, overmolding onto the cover of the pump casing.

In the case where the pump is submerged in a liquid (urea for example) tank, the pump casing preferably comprises a part in the shape of a bell that preferably does not extend (at least not completely) to the bottom of the tank and is not next to the filter. Most particularly preferably, the bell and the filter are positioned so as to create a path for the fluid such that, when the pump is in "forward" drive (in order to supply the fluid), the fluid is sucked up from underneath the bell through an annular cavity between the inner surface of the bell and the outer surface of the filter, to be finally sucked up through this filter by the mechanical pumping element.

In other words: the bell preferably has at least one opening in its lower part (which is preferably an annular opening that occupies its entire lower circumference, which means to say that the bell rests on the filter in fact and not on the bottom of the tank) and it is positioned so as to create an annular cavity between its inner surface and the outer surface of the filter via which the liquid can be sucked up through the filter via the lower opening of the bell.

The advantage of this variant is that if the pump and the filter are purged (for example by rotating the pump in the reverse direction, then by stopping it), an air pocket is formed around the filter which ensures that the latter remains dry until the pump is restarted, which will hence be quicker in the case of freezing (since the formation of a plug of ice in the filter will thus have definitely been prevented).

The variant with submerged pump, filter, pump body with upper bell and lower chamber is particularly advantageous in the case where the pump according to the invention is integrated into a base plate submerged in a tank. Such a base plate is, for example, described in Application PCT/EP2007/055613 in the name of the Applicant, the content of which is, for this purpose, incorporated by reference in the present application. The expression "base plate" is understood to mean generally a mounting plate or part that is flattened (i.e. the thickness of which part is smaller than its length or its diameter) intended to block off an opening in the lower wall of the tank. It should be noted that this part may be hollow and define a chamber which communicates with the tank via an orifice through which the additive can flow. It generally has a perimeter, closed up on itself, of any shape. Usually, its perimeter has a circular shape. Preferably, this base plate integrates several other active storage and/or metering elements and, most particularly preferably, it integrates all the active components which are brought to be in contact with the liquid additive found in, leaving from or arriving into the additive tank.

In this case, it is advantageous for the lower chamber of the pump casing to comprise a substantially cylindrical wall provided with a base and molded in one piece with the base plate. Preferably, the casing also comprises a cover assembled in a sealed manner with this cylindrical wall.

The present invention also relates to a compact module comprising a pump, a filter at least partly surrounding the pump.

Preferably, this module is integrated into a base plate submerged in a liquid tank such as described previously.

Hence, the present invention also relates to a liquid tank in which a pump as described above is submerged such that the pump casing comprises a part in the shape of a bell which has at least one opening in its lower portion and which is positioned so as to create an annular cavity between its inner surface and the outer surface of the filter via which the liquid can be sucked up through the filter.

Preferably, the invention also relates to a liquid tank in which the pump is integrated into a base plate submerged in the tank and the lower portion of the pump casing comprises a substantially cylindrical wall provided with a base which is molded in one piece with the base plate.

The invention also relates to the use of a pump or of a tank as described above in an SCR system (system for selective catalytic reduction of the $NO_x$ in the exhaust gases of a vehicle) using a eutectic water/urea solution.

Figure 2:
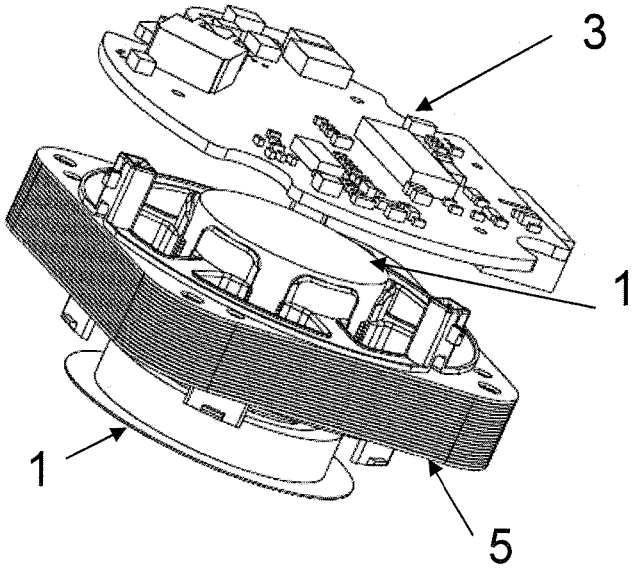
FIG. 2 illustrates an exploded view of these same components as shown in FIG. 1.
Figure 3:
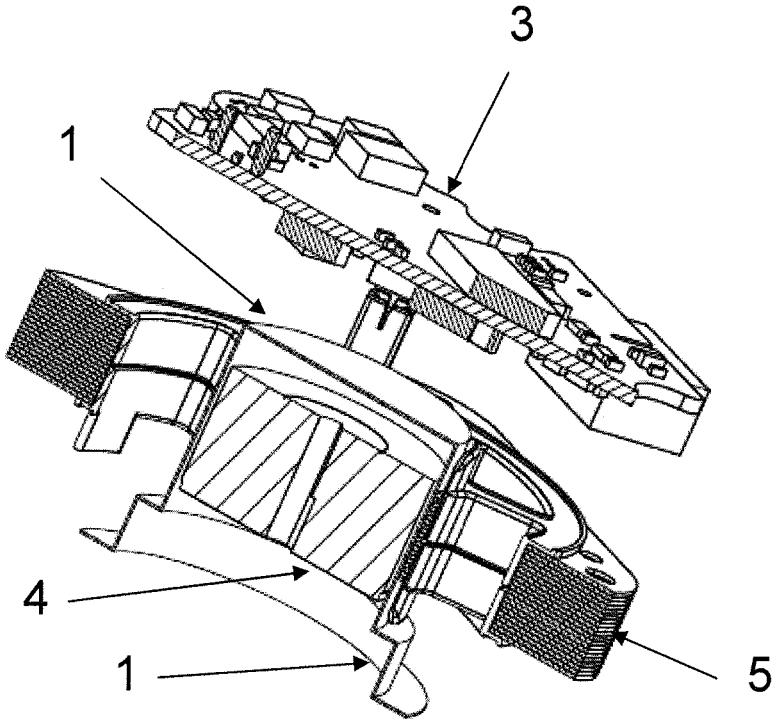
FIG. 3 illustrates an exploded cross-sectional view of these same components as shown in FIG. 1.
Figure 4:
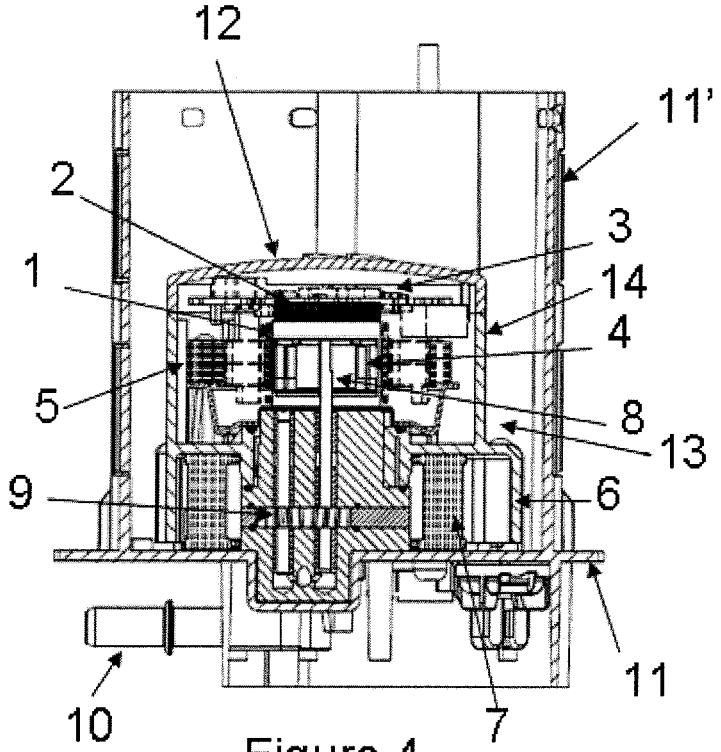
FIG. 4 illustrates a vertical cross section of a pump and of a submerged base plate according to a similar variant.
Figure 5:
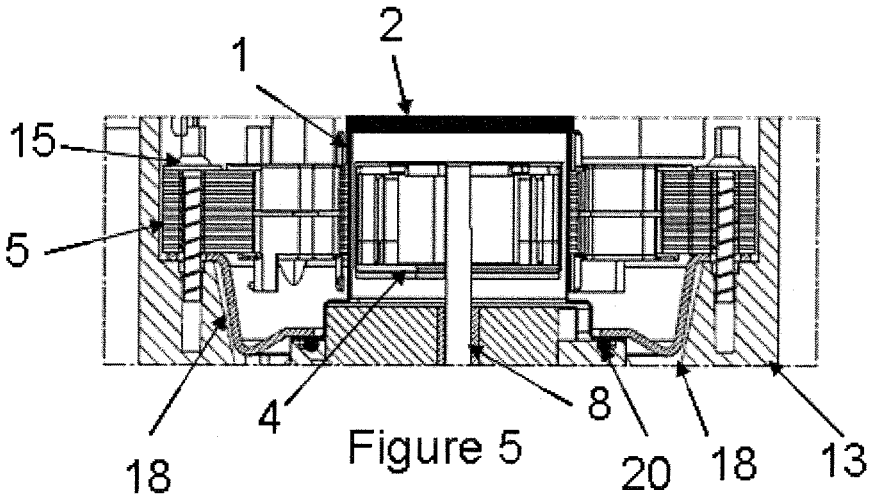
FIG. 5 illustrates an enlargement of one part of a pump according to another variant similar to that of FIG. 4.

The present invention is illustrated, in a non-limiting way, by FIGS. 1 to 11 which show:

FIG. 1: a vertical cross section through certain components of a pump according to one preferred variant of the invention;

FIG. 2: an exploded view of these same components;

FIG. 3: an exploded cross-sectional view of these same components;

FIG. 4: a vertical cross section of a pump and of a submerged base plate according to a similar variant;

FIG. 5: an enlargement of one part of a pump according to another variant similar to that of FIG. 4;

FIGS. 6, 7: a rotation axle and a rotor of a pump according to one advantageous variant of the invention;

FIGS. 8-11: schematically, various methods of fastening a pressure sensor to a rotor housing.

In these figures, identical numbers denote identical components.

Illustrated in FIG. 1 is a housing (1) that surrounds a magnetic rotor (4) of a pump according to one advantageous variant of the invention and that is intended to inject a solution of urea into the exhaust gases of a diesel engine vehicle. The housing (1) comprises an upper wall (1'). A stator (5) is positioned all around the housing (1). A pressure sensor (2) is fastened to the upper wall (1') of the housing (1). This comprises an electronic board (not represented) which is electrically connected to an electronic board (3) for controlling the pump. The electronic board of the sensor may be overmolded onto or integrated into the electronic board (3). The electronic board (3) consists, for example, of a printed circuit board (PCB).

FIGS. 2 and 3 illustrate the housing (1) which is surrounded by the stator (5). Above the upper wall (1') of the housing (1) is the PCB (3) and between the upper wall (1') and the PCB (3), it is possible to integrate the pressure sensor (2) as illustrated in FIG. 1, which can be achieved in several ways, in particular that are illustrated in FIGS. 8 to 11.

FIG. 4 represents a cross-sectional view of a variant of the pump which is integrated into a submerged base plate (11). The base plate (11) comprises a urea trap (11') molded in one piece with it, and also an outlet pipe (10), also molded in one piece with it and intended to be connected to a line for supplying urea to the exhaust gases of an engine (components that are not represented). According to this variant, the pump is surrounded by a casing that comprises a lower chamber (13) and a cover (12). The lower chamber (13) comprises a lower portion (6) and an upper portion (14).

The lower portion (6) surrounds a filter (7) and has, in its bottom part, a peripheral opening to the urea trap (11') so that the urea present in the urea trap (11') can be sucked up by the pump through the peripheral opening and the filter (7). The pump comprises a rotation axle (8) which is attached to a rotor (4) and a mechanical pumping element (9). The rotor (4) is surrounded by a housing (1) in which the urea circulates and which is fastened in a sealed manner to the lower chamber (13).

The housing (1), the cover (12) and the upper portion (14) constitute a chamber that is impermeable to urea.

The housing (1) is surrounded by magnetic coils that constitute the stator (5). The operation of the pump is governed by a controller (not represented) comprising at least one electronic board (3).

FIG. 5 represents an enlargement of a part of a pump according to another variant similar to that of FIG. 4 illustrating the rotor/housing/stator assembly. In this figure, the housing (1) is fastened to the lower chamber (13) by means of flanges (18) and in a sealed manner by means of an O-ring (20). The stator (5) is fastened to the lower chamber (13) by means of screws (15).

Illustrated in FIG. 6 is a rotation axle (8) of a pump as illustrated in FIG. 4. The axle (8) is attached to a mechanical pumping element (9) and comprises, at one end intended to be attached to the rotor, a flat section (16), the shape of which is capable of cooperating with a corresponding profile (17) made in the rotor (4) so that, when the rotor (4) is driven by magnetic coupling with the stator (5), the axle (8) is also driven and the mechanical pumping element is capable of creating a movement for conveying urea through the pump.

FIGS. 8 to 11 represent various variants of the system according to the invention.

FIG. 8 illustrates the variant where the pressure sensor (2) constitutes the upper wall of the housing (1). It may be fixed to it by crimping (folding the upper edge of the lateral wall of the housing onto it). The pressure sensor (2) comprises a measuring element and an electronic board which is electronically connected, via electrical connections (19), to an ECM (not represented) for controlling the pump.

In the variant in FIG. 9, the pressure sensor (2) is fastened (for example by overmolding or gluing) to the upper wall of the housing (1) on the internal side of the latter, i.e. where the urea circulates. An orifice is made in the upper wall of the housing (1) so that the electrical connections (19) can pass through the wall of the housing (1) and allow an electrical connection to be established between the electronic board and the ECM.

In the variant of FIG. 10, the upper wall of the housing (1) comprises a duct (21) provided with 2 ends, one end leading to the inside of the housing (1) and one end to which the pressure sensor (2) is connected. According to this variant, the sensor (2) is in contact with the fluid that circulates in the pump, at a distance from the upper wall of the housing (1).

In the variant from FIG. 11), the measuring element (2") and the electronic board (2') of the pressure sensor (2) are separate and are electrically connected via the connections (19). Only the measuring element is fastened to the upper wall of the housing (1) in line with an opening made in the housing (1), the electronic board being electrically connected to the ECM.

The invention claimed is:

1. A tank for an exhaust gas pollution control liquid, the tank comprising: a rotary pump including a casing including a lower chamber, a pressure sensor positioned within a main internal volume of the casing, the pressure sensor being in contact with the liquid, a rotor contained in a fixed housing, the rotor being connected by a shaft to a mechanical pumping element, and a stator enclosed with an electronic board in a sealed chamber, separate from a lower portion that circumferentially surrounds the fixed housing, a filter, and the mechanical pumping element, wherein the pump casing includes a part in the shape of a bell which has at least one opening in its lower portion and which is positioned so as to create an annular cavity between an inner surface of the pump casing and an outer surface of the filter contained in the fixed housing, wherein the liquid is sucked up through the filter via the annular cavity, and wherein the fixed housing includes an upper wall, wherein the fixed housing has a substantially cylindrical shape, wherein the fixed housing is fixed to the lower chamber, and wherein the pressure sensor is fixed to the upper wall of the fixed housing.

2. The tank according to claim 1, wherein the pump is integrated into a base plate submerged in the tank, and wherein the lower portion of the pump casing comprises a substantially cylindrical wall provided with a base which is molded in one piece with the base plate.

* * * * *